US005628098A

United States Patent [19]

Beerli et al.

[11] Patent Number: 5,628,098

[45] Date of Patent: May 13, 1997

[54] METHOD AND DEVICE FOR THE WINDING OF WARP STRIPS

[75] Inventors: Markus Beerli, Gossau; Hans-Peter Steg, Wil, both of Switzerland

[73] Assignee: Benninger AG, Uzwil, Switzerland

[21] Appl. No.: 352,838

[22] Filed: Dec. 2, 1994

[30] Foreign Application Priority Data

Dec. 22, 1993 [CH] Switzerland ..... 3820/93

[51] Int. Cl.[6] ..... D02H 5/02; D02H 9/02; B65H 75/28; B65H 65/00

[52] U.S. Cl. ..... 28/191; 28/208

[58] Field of Search ..... 28/191, 196, 208, 28/205

[56] References Cited

U.S. PATENT DOCUMENTS

| | | | |
|---|---|---|---|
| 1,096,702 | 5/1914 | Fleischer | 28/191 |
| 2,537,007 | 1/1951 | Abbot | 28/191 |
| 2,940,687 | 6/1960 | Mason | 28/191 |
| 4,683,625 | 8/1987 | Baltzer | 28/191 |
| 4,831,695 | 5/1989 | Baltzer | 28/191 |
| 4,876,775 | 10/1989 | Steele et al. | 28/208 |
| 5,022,128 | 6/1991 | Beerli et al. | 28/191 |

FOREIGN PATENT DOCUMENTS

| | | |
|---|---|---|
| 669303 | 3/1989 | Switzerland . |
| 93/19233 | 9/1993 | WIPO . |

*Primary Examiner*—Andy Falik
*Attorney, Agent, or Firm*—Shoemaker and Mattare, Ltd.

[57] ABSTRACT

A manipulator (16) is provided in the case of a method and device for winding of warp strips (19) in at least two adjacently arranged sections onto the drum (9) of a sectional warping plant. On completion of the winding sequence for a section, the yarns of the warping strip (19) are separated, and not only the strip-start (29) oriented towards the yarn feed arrangement (10, 11) but also the strip-end oriented towards the drum (9) is joined by at least one flat body (18, 18*a*), transverse to the run of the yarns, and are thus fixed.

13 Claims, 5 Drawing Sheets

METHOD AND DEVICE FOR THE WINDING OF WARP STRIPS

BACKGROUND OF THE INVENTION

The invention concerns both a method and a device for winding warp strips, which are guided from a yarn feed arrangement, and wound onto the drum of a sectional warping installation in at least two adjacently arranged sections. In sectional warping machines, yarns are drawn off a bobbin creel, brought together by means of yarn guidance equipment and wound onto a drum as so-called warp strips. According to the required warp width and the number of yarns, winding of the separate warp strips is repeated in numerous different sections.

In the case of installations according to the state of the art, each individual strip-start is fixed to the drum manually, e.g. knotted and hooked into corresponding fixing points. In addition, after manual separation, the strip-ends are fixed to the surface of the winding. This manual intervention frequently causes irregularities to the sectional warping beam structure. An exact run of yarns in the follow-up section is frequently unable to be ensured. Loose, individual yarns often are often experienced. Manual intervention leads to extensive periods of lost operating time.

SUMMARY OF THE INVENTION

The invention has the purpose of avoiding these known disadvantages, in particular of creating a method and a device, therefore, for winding warp strips with which on the one hand a homogenous structure of the sectional warping beam is ensured, and on the other hand with which the periods of plant stand-still, for attachment of the strips onto the drum, are reduced to a minimum, and with which the manual tasks required for the sectional warping process as a whole are kept to a minimum.

According to the invention, this purpose is primarily fulfilled in accordance with the characteristic features of the independent patent claims. Through optimal attachment of the strip-ends, as anticipated by the invention, a defined limit of both the winding start and the winding end can be attained, not only on the side oriented towards the yarn feed arrangement but also on the side oriented towards the winding. In addition, by this means the warp strips can be aligned and/or attached to the drum in the most optimally simple way. With that, attachment can, for example, ensue with either mechanical clamping devices or, preferably, by means of adhering tape.

Flat bodies particularly suited to fixing are adhering strips or thermoplastic strips, the latter being melted by heating to their melting temperature and thence joined to the yarns. These types of flat bodies are, for example, described in WO 93/19233 or CH-A1-669 303. By using flat bodies for attachment of the strip-ends, the method can be automated in a particularly simple way.

The automation process can be mainly further improved if the strip is fixed approximately parallel to the drum by means of a flat body and if the flat body is then, together with the fixed yarns, separated into two parts, in particular cut, parallel to the drum. In this way, not only the strip-end oriented towards the drum, but also the strip-end oriented towards the yarn feed arrangement, can be fixed in one single working sequence.

Particularly reliable and firm fixation of the strips can be achieved if at least two adhering or weldable flat bodies are applied, one to each side of the warp strip, thereby fixing the yarns with respect to one another at each of two places, and then the yarns are cut between those places.

The strip-ends can be fixed to the surface of the yarn winding in a particularly simple and reliable way if the yarns are fixed by two consecutive flat bodies which are applied to the warp strip at a spacing of one winding circumference, so that during winding the second flat body will come into contact with and will be affixed, and preferably bonded to, the first flat body after one revolution of the winding.

The application of the start of the warp strip onto the drum is made particulary simple if the length of the flat body corresponds to the width of one winding section and if the lateral yarn spacing of the warp strip yarns is reduced prior to joining so that the edge yarns are sure to be included in the bond. By this means, the flat body can in each case be simply accommodated adjacent to the previous winding section. Attachment of the flat body onto the drum can be realized in a particularly simple way if this is bonded to the drum with an adhering strip.

For automation of the method, a particularly suitable device possesses at least one means for applying a flat body onto the warp strip and which, in addition, possesses a separating device for separation of the yarns and/or the flat body or the flat bodies, and which is provided with a manipulator for applying the fixed yarns onto the drum, said manipulator being able to travel transversely along the drum. When employing meltable flat bodies, at least one heater installation is provided on the application device. This can, for example, be a heated pad. Alternatively, it is also conceivable that, for example, a hot-wire is provided in the flat body itself, which can be heated through connection to a current source.

The device can be realized in a particularly simple and compact way if the heater device and/or the cutting device is provided on the manipulator. By this means, during displacement of the manipulator, the heater device and the cutting device will be simultaneously displaced from section to section.

BRIEF DESCRIPTION OF THE DRAWINGS

The invention is more closely explained in the following embodiments, and with the aid of the drawings, wherein.

DESCRIPTION OF THE PREFERRED EMBODIMENT

Figure 1:
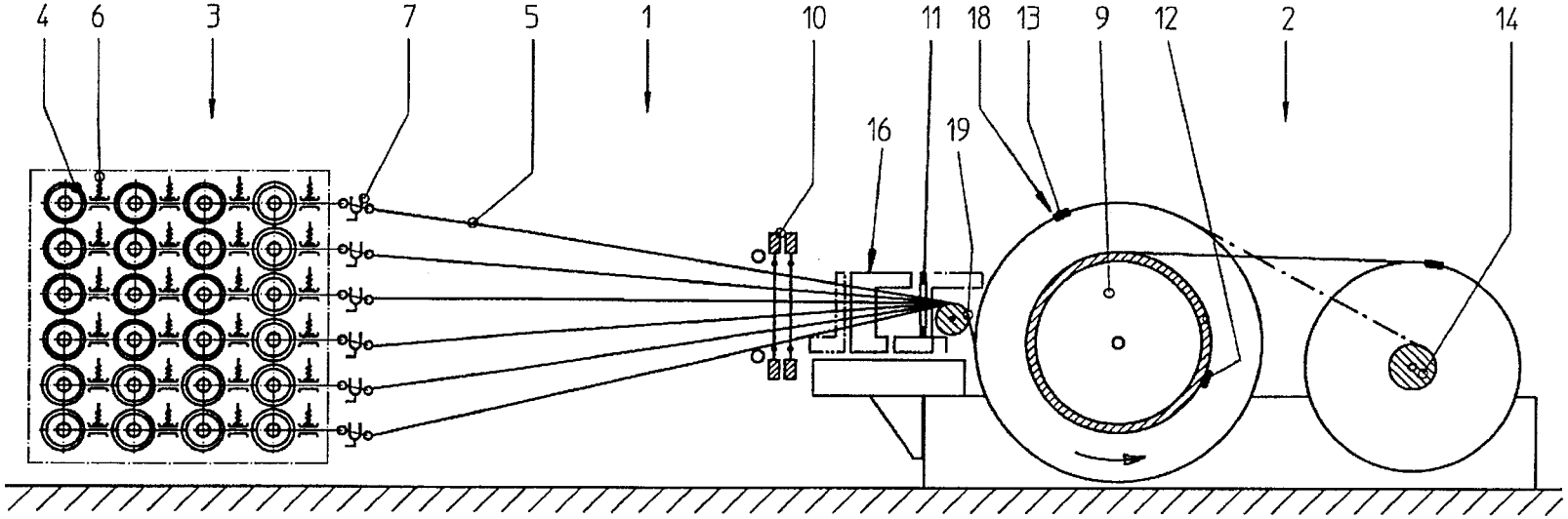
FIG. 1 is a schematic representation of a sectional warping plant.
Figure 2:
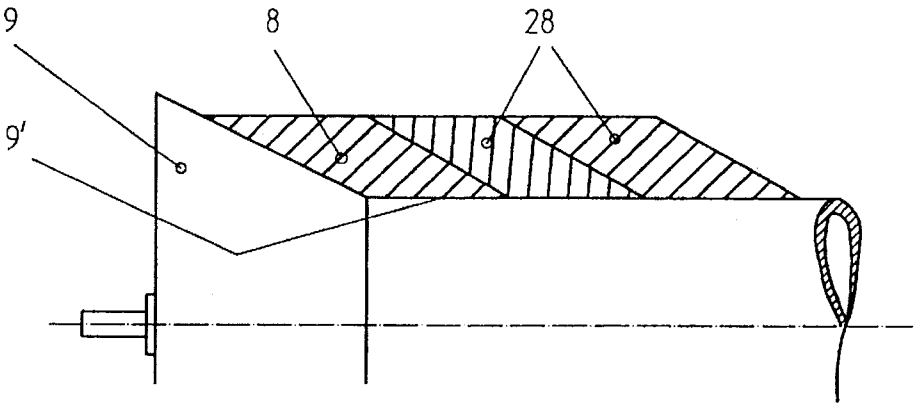
FIG. 2 is a detailed representation of a warp winding in numerous sections.

As FIGS. 1 to 7 show, on a sectional warping plant 1, yarns 5 are drawn off the bobbins 4 of a bobbin creel 3 and are wound by a conical sectional warping machine 2 in sections 8 onto a conical drum 9 (FIG. 2). The yarns 5 are given a definite tension by means of controlled yarn tensioners 6, are checked for breakage by a yarn monitor 7, are ordered according to the desired pattern in a yarn crossing device 10, are brought to the correct yarn density by means of a warp reed 11, and are then fed to the drum 9 as a warp strip 19. The warp strip is repeatedly wound in sections 8, 28, in line with the required warp width and number of yarns, with subsequent windings 28 following on from the first section 8, according to FIG. 2. For each winding procedure of one of the sections 8, 28, the strip-start 12 must be affixed to the drum, the warp strip 19 must be separated after reaching the required warp length, and the strip-end 13 (FIG. 4) must be affixed to the circumference of the winding of each section 8, 28. Finally, all warp strips are rewound together from the sectional warping drum 9 onto the warping beam 14.

At commencement of sectional warping, after threading of the yarns 5 through the yarn crossing device 10 and warping reed 11, the warp strip is affixed manually onto the drum 9. (Alternatively, also in the case of the first section 8, the warp strip can be attached automatically, in accordance with the procedure to be described in the following.)

Figure 3:
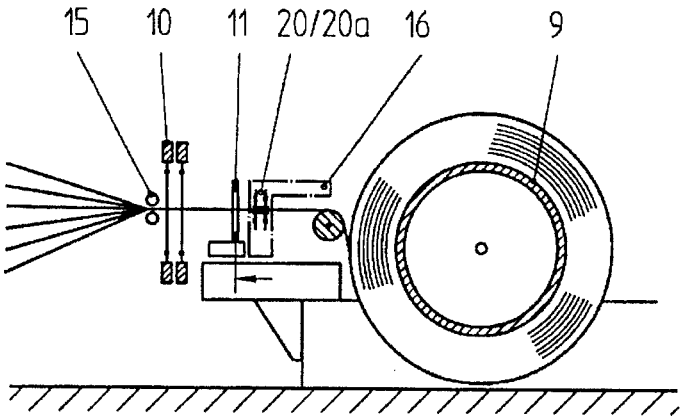
FIGS. 3 to 6 shows the plant according to FIG. 1, at various stages of the winding procedure.
Figure 4:
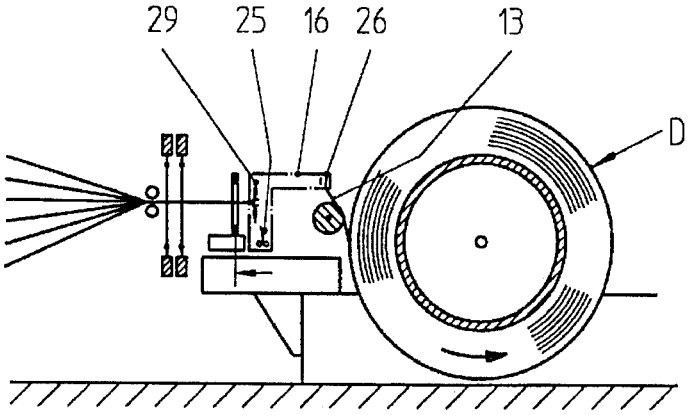
Figure 5:
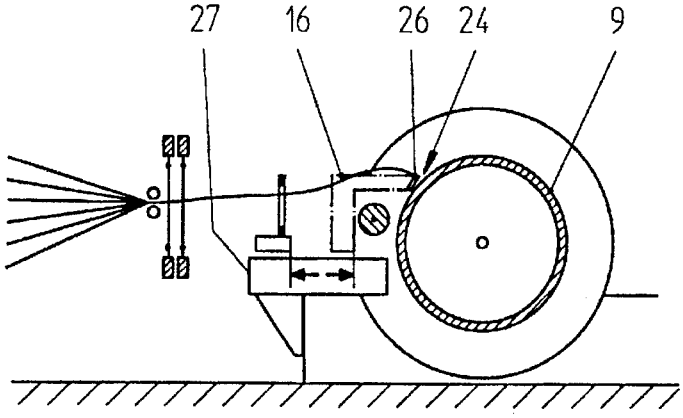
Figure 6:
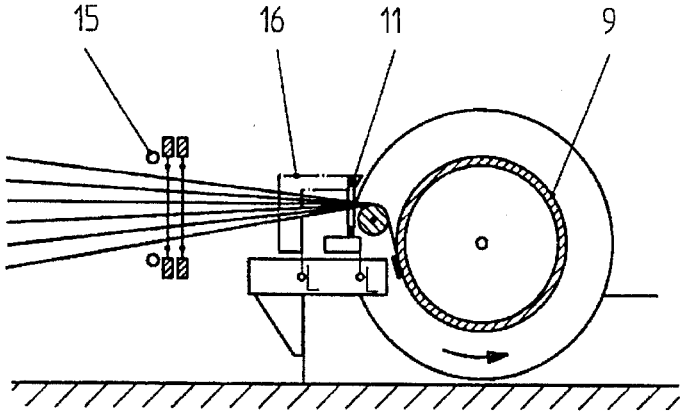

As soon as the warp length has been reached in the winding procedure, the guide rods 15 of the yarn crossing device 10 close the yarn sheds (FIG. 3). The warp reed 11 is displaced in the direction of the yarn crossing device 10, and thus provides working space between the warp reed 11 and the drum 9 for a manipulator 16. The manipulator 16 is provided with two strip dispensers 17 and 17*a*, which apply two thermoplastic strips 18, 18*a* above and below the warp strip 19. Simultaneously, the warp strip 19 is narrowed in this region to a width which is less than the width b of a section 8, 28. Now the heating pads 20, 20*a* are pressed together, the thermoplastic strips 18, 18*a* between them being melted in the area of two welded seams 21 and welded together in such a way that the warp strip 19 between them will become fixed.

Figure 7:
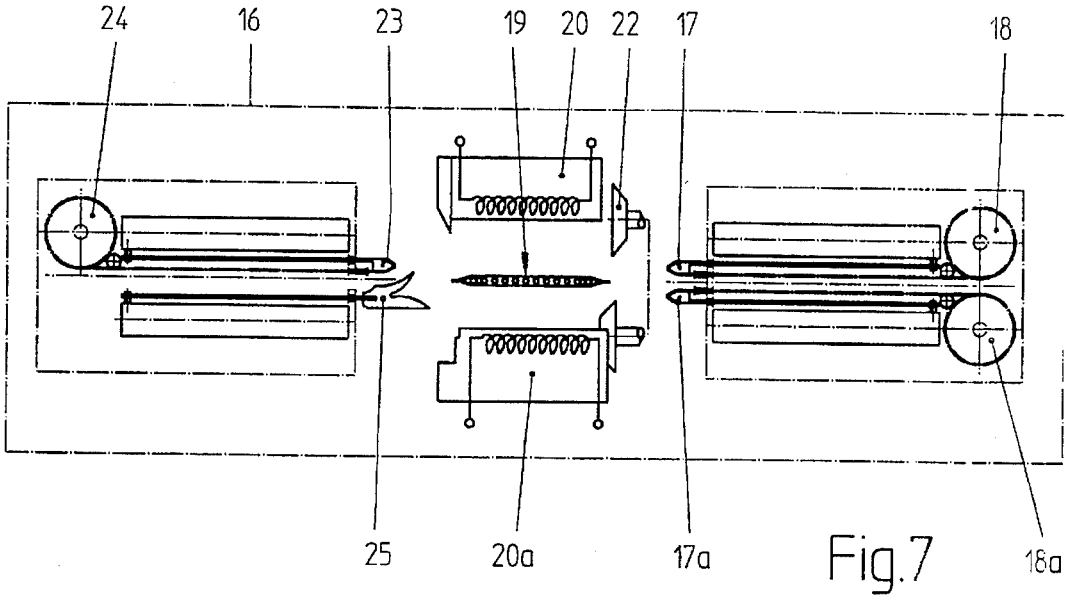
FIG. 7 is a schematic representation of the manipulator according to FIGS. 1 to 6 at an enlarged scale.
Figure 8:
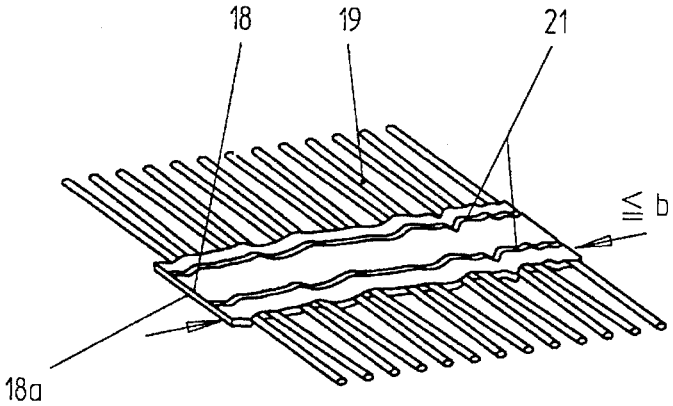
FIG. 8 shows a fixed warp strip.
Figure 9:
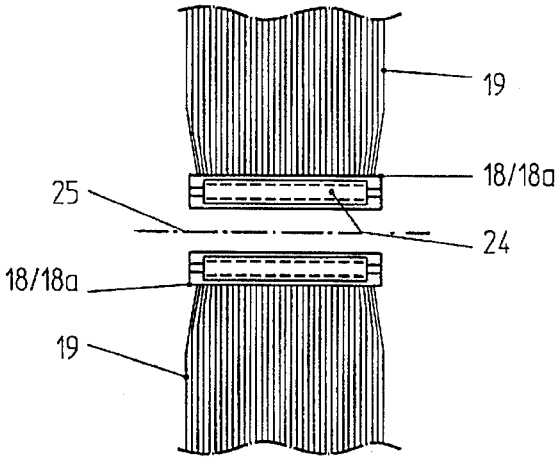
FIG. 9 shows a warp strip, fixed by means of a flat body, after separation of the flat body.

A cutting device 22 integrated into the manipulator cuts the welded thermoplastic strips 18, 18*a* to the width b (FIG. 8), which is approximately the equivalant of the width b of a section 8, 28. Evidently, the thermoplastic strips 18, 18*a* serve as flat bodies for fixation of the warp strip in one plane. In accordance with the particular application and the flat body used, for example a thermoplastic strip can be used only on one side, or special adhering tapes can be used, or other means of fixation in the form of flat bodies. After attachment of the first pair of thermoplastic strips 18, 18*a*, the drum 9 is rotated further, through one revolution, in accordance with FIG. 4. A second fixing sequence by means of thermoplastic strips 18, 18*a* now ensues in the manipulator 16 (FIG. 8). With that, a double sided adhering tape 24 is applied to the upper thermoplastic strip 18*a* by means of a second strip dispenser 23 (FIG. 7). By means of the separating device 25, the warp strip 19 is now cut approximately along the middle of the thermoplastic strips 18, 18*a*, transverse to the drum. As can be seen in FIG. 9, as a result not only the end of the warp strip oriented towards the drum 9, but also the end oriented towards the bobbin creel 3, will be fixed.

The strip-end 13 oriented towards the sectional warping drum 9 is now bonded by a feed mechanism 26 of the manipulator 16 (FIG. 4) to the thermoplastic strip 18 which has been applied in the preceding working sequence. Conversely, the strip-start 29 oriented towards the creel 3 is held by the manipulator 16, and displaced with said manipulator by means of a warp support 27 (FIG. 5) parallel to the drum 9 into the start position for the follow-on winding 28 (FIG. 2). The strip-start 29 is now affixed by means of an adhering strip 24 to the drum by the feed mechanism 26 of the manipulator 16 according to FIG. 5. After yarn tensioning, the guide rods 15 (FIG. 6) open, the manipulator 16 takes up its rest position, and the warp reed 11 takes up its operating position. The next sectional warping process commences for a follow-on winding 28. As flat bodies, instead of thermoplastic strips or adhering strips, also Velcro, magnetic or other fixable (sewable or rivetable) flat bodies can be used. When employing these types of flat bodies, it is only necessary to replace the heating pads 20, 20*a* with an appropriate device for joining the warp strip to the flat body. The adhering strip 24 can be replaced, for example by a Velcro strip, a magnetic strip or another connecting means, without departing from the framework of the invention.

Figure 10:
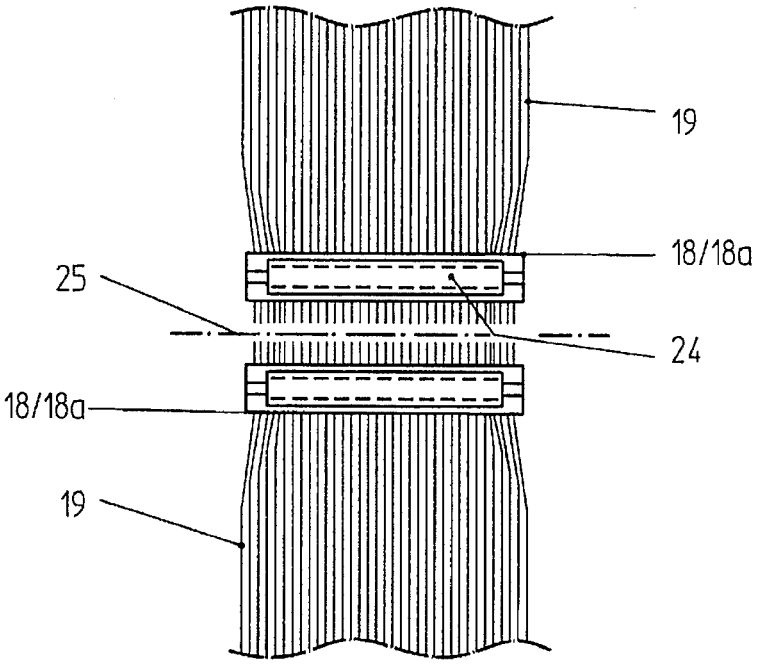
FIG. 10 shows a warp strip fixed by means of two strips of flat articles, and FIG. 11 a warp strip-end, respectively a warp strip-start, fixed by means of a flat body.

FIG. 10 shows a modified version with which the warp strip 19 is fixed by two pairs of parallel thermoplastic strips 18, 18*a*. In order to separate the warp strip 19, the separating device 25 cuts the yarns of the warp strip 19 in the gap between the two pairs of thermoplastic strips 18, 18*a*.

Figure 11:
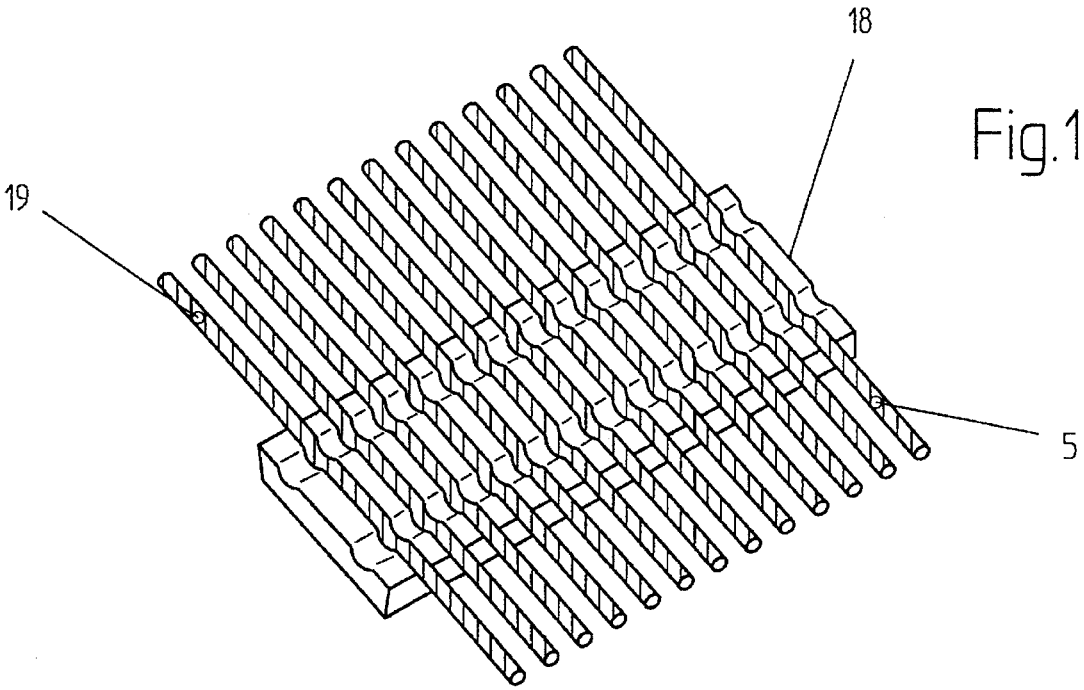

FIG. 11 shows a modified version, with which a relatively thick thermoplastic strip 18 is applied to one side only, and is joined to the yarns 5 by melting. With that, the yarns 5 are if necessary only embedded in the melted material of the thermoplastic strip 18 at individual points.

Figure 12:
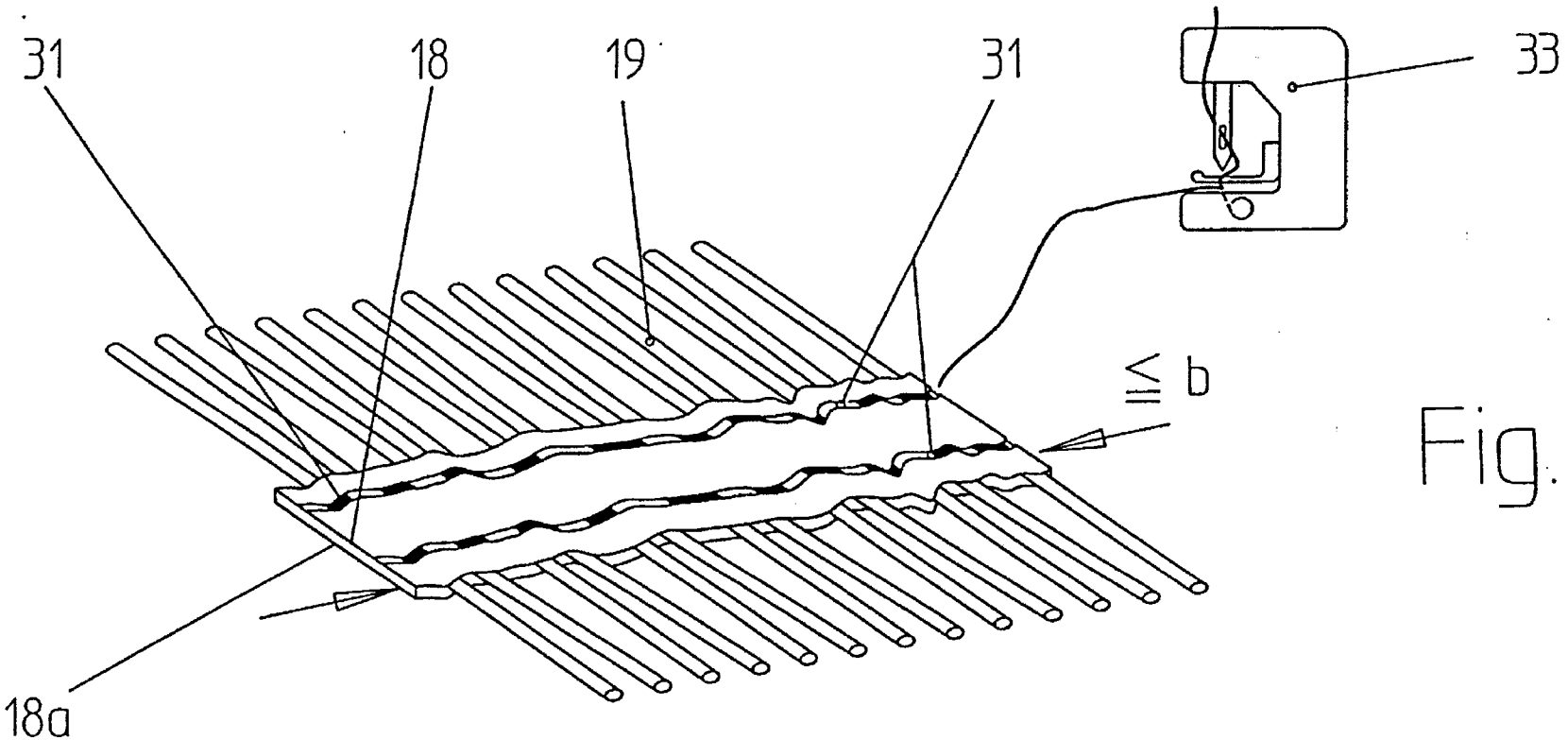
FIG. 12 shows a the yarns of a warp strip-end being affixed to a flat body by sewing.

FIG. 12 shows a modification in which the yarns of the warp strip 19 are secured to the flat body 18 by stitches 31 applied by a sewing device 33.

Evidently, with such a sectional warping procedure or sectional warping device, the warping process can ensue practically fully automatically. Fixation of the warp strip ensues within the plane of the strip, the simultaneous fixation of the strip-end and the strip-start representing a particular simplification of the automation process. Irregularities in the winding caused by knots or uneven running of the yarns in the area of the strip-edges are avoided. Through the parallel fixation of all individual yarns in the tensioned condition, irregularities caused by slack individual yarns or interference from loose yarns on the creel are thus avoided. No slack strip-ends will result on the warp winding, and attachment rails or special attachment devices on the drum circumference will also be avoided.

Inasmuch as the invention is subject to modifications and variations, the foregoing description and accompanying drawings should not be regarded as limiting the invention, which is defined by the following claims and various combinations thereof:

What is claimed is:

1. A method of securing the ends of warp yarns as they are drawn from a creel and wound onto successive adjacent sections of a drum, the method comprising steps of, as the winding of one section is completed, closing the yarns to form a flat strip of yarns, fixing the yarns with respect to one another at each of two places, one nearer the creel and one nearer the drum, by applying to the yarn strip at least one flat body extending transverse to the length of the yarns and having means for securing the yarn to the strip, cutting the yarns between said two places, where they are secured by the flat body, so as to form a trailing end on the yarn strip nearer the drum and a leading end on the yarn strip nearer the creel, and then securing the respective secured strip ends to the drum.

2. The invention of claim 1, wherein the yarns of the warp strip are fixed by applying the flat body approximately parallel to the drum's axis, and then separating the flat body, together with the respective yarns, into two parts, along a line parallel to the axis of the drum.

3. The invention of claim 1, wherein the yarns are fixed by applying said at least one flat body on both sides of the warp strip each said body having a surface which adheres to the yarns.

4. The invention of claim 1, wherein the flat body is fastened to the drum by securing it with an adhering band.

5. The invention of claim 1, wherein the warp strip is fixed by applying two said flat bodies to the warp strip at a spacing such during winding, the second flat body comes to lie upon the first flat body after one winding rotation.

6. The invention of claim 5, comprising a further step of connecting the first flat body and the second flat body as they lie together.

7. The invention of claim 1, wherein the length of the flat body is equal in width to the drum section, and the lateral spacing of the yarns of the warp strip is reduced prior to applying the flat body to the warp strip, so that the strip width is no longer than the wound section is wide.

8. A device for winding warp yarns arranged in strips onto a drum of a section warping plant so as to form successive adjacent sections of windings on the drum, said device comprising means for applying at least one flat body, extending transverse to the length of the yarns and for securing the yarns of each yarn strip with respect to one another at each of two places, at different distances from the drum, means for cutting the yarn strips between said two places, transverse to the length of the yarns, so as to form a trailing end on the yarn strip nearer the drum and a leading end on the yarn strip nearer the creel, and means for securing both fixed yarn strip ends to the drum.

9. The invention of claim 8, wherein the flat body is thermoplastic, and the applying means comprises at least one heater for heating the flat body to its melting temperature.

10. The invention of claim 9, wherein the heater is provided in the flat body itself.

11. The invention of claim 8, wherein the flat body itself includes a separating device.

12. The invention of claim 8, wherein the flat body comprises at least one adhesive tape dispenser.

13. The invention of claim 8, wherein the flat body includes a sewing device.

* * * * *